US005244434A

United States Patent [19]

Stoney et al.

[11] Patent Number: 5,244,434

[45] Date of Patent: Sep. 14, 1993

[54] VENTILATOR

[75] Inventors: Arthur Stoney, Halstead; Nigel Smith, Colchester, both of England

[73] Assignee: Titon Hardware Limited, Colchester, United Kingdom

[21] Appl. No.: 730,777

[22] PCT Filed: Jan. 23, 1990

[86] PCT No.: PCT/GB90/00095

§ 371 Date: Aug. 1, 1991

§ 102(e) Date: Aug. 1, 1991

[87] PCT Pub. No.: WO90/08927

PCT Pub. Date: Aug. 9, 1990

[30] Foreign Application Priority Data

Jan. 24, 1989 [GB] United Kingdom ..... 89014732

[51] Int. Cl.[5] ..... E06B 7/02

[52] U.S. Cl. ..... 454/213; 454/222; 454/333

[58] Field of Search ..... 454/211, 213, 222, 333, 454/334; 98/98

[56] References Cited

U.S. PATENT DOCUMENTS

| | | | |
|---|---|---|---|
| 3,094,058 | 6/1963 | O'Brien, Jr. et al. | 454/211 X |
| 3,343,475 | 9/1967 | Costley | 454/222 X |
| 4,702,157 | 10/1987 | Comparon | 454/211 |
| 4,727,797 | 3/1988 | Smith | 454/213 |
| 4,736,677 | 4/1988 | Smith | 454/213 |

FOREIGN PATENT DOCUMENTS

| | | |
|---|---|---|
| 1417751 | 12/1975 | United Kingdom . |
| 1582946 | 1/1981 | United Kingdom . |

*Primary Examiner*—William E. Tapolcai

*Attorney, Agent, or Firm*—Price, Heneveld, Cooper, DeWitt & Litton

[57] ABSTRACT

A controllable slot ventilator has a housing and a closure member pivotably mounted on the housing to selectively close a vent in the housing. The closure member is supported on linking elements which are mounted on the closure member. The linking elements are arranged so as to rotate when the closure is moved between the open and closed position. The angle between a line, passing between the pivot points of the linking element, and the general plane of the closure member increases when the closure member moves to the open position.

23 Claims, 3 Drawing Sheets

VENTILATOR

BACKGROUND OF THE INVENTION

The present invention relates to ventilators, more particularly but not exclusively for use in rooms with sealed windows and/or double glazing where it is desirable to provide ventilation without having to open the window. This type of ventilation is now usually referred to as "secondary ventilation".

Secondary ventilation is often achieved by the insertion of a slot ventilator into a slot cut or formed in the sash of a window, the slot connecting through an air passage usually to the exterior of the building. Air flow through the resulting ventilation passage is controlled by some sort of openable or closable ventilator such as a hit and miss ventilator or a parallel motion ventilator of the type described in UK patent 1417751.

While the known type of parallel motion ventilator has been found to be excellent in practice, there are certain specific situations in which yet further improvements can be made. Firstly, it has been found that the "throw" of the ventilator, in other words the distance forward of the main ventilator body by which the facing strip or closure member has to be moved in order fully to open the ventilator, can be further reduced by means of an improved linkage, making it even less likely for a user accidentally to snag the closure member when it is in the open position. Furthermore, the applicants have now found a way to increase the effective air opening of the ventilator without reducing its size.

The other type of known ventilator, the so called "hit and miss" ventilator , has to be relatively large in relation to its air opening since the configuration of the ventilator itself cuts down the air flow. This type of ventilator comprises a fixed slotted panel mounted over an aperture, for example in a window sash, with a similar slotted panel arranged for sliding movement with respect to the fixed one. In the open position of the ventilator the slots in the two panels line up, so allowing air to pass, whereas in the closed position the slots in one panel line up with the bars between the slots of the other. As will be evident, the maximum air flow through a ventilator of this type is very substantially less than the maximum air flow which could otherwise flow through the aperture on which it is mounted; less than 50% would be a typical figure.

The known ventilators, then, if they are designed in order to allow through them a specified air flow, must be provided with an aperture in the window which is larger than would actually be needed to support such an air flow in the absence of the ventilator. This has tended to mean that known ventilators, especially the hit and miss type are excessively bulky for the air flow that they actually allow through. In recent years, this problem has become more acute as manufacturers of timber windows try to save as much timber as possible by providing only a very narrow sash between the glass and the window frame. This has meant that the apertures in such sashes, which have to be provided with ventilators, are now very narrow, with little space between the edge of the aperture and the frame for a bulky ventilator to be positioned. In addition, the head profiles of modern windows (that is the distance between the surface of the sash and the surface of the frame, in a direction perpendicular to the glass) are very narrow. For both practical and ascetic reasons it is not desirable to have any part of the ventilator, either in the open or in the closed position, which extends forwardly of the surface of the frame. This of course restricts the length of the throw.

It is an object of the present invention at least to alleviate at least some of the difficulties of the prior art.

It is another object of the invention to provide a compact controllable ventilator which allows through it all, or substantially all, of the air flow capable of passing through the aperture to be controlled.

SUMMARY OF THE INVENTION

According to a first aspect of the present invention there is provided a controllable slot ventilator comprising a main housing arranged for securement to the front face of a member having a vent to be controlled, the housing having first and second parallel side walls located, when the housing is so secured, forward of the said front face and defining therebetween a slot in communication with the vent; and an elongate closure member mounted for parallel motion between a closed position obstructing the slot, and an open position, the closure member having a portion or portions which extend into the slot and to which are pivotally mounted parallel motion links, each link also being pivotally secured with respect to the side walls of the housing, the links rotating as the closure member is moved to the closed position so as to increase the acute angle between a line passing between the pivot points of each link and the general plane of the closure member.

According to a second aspect of the invention there is provided a controllable slot ventilator comprising a main housing arranged for securement to the front face of a member having a vent to be controlled, the housing having first and second parallel side walls located, when the housing is so secured, forward of the said front face and defining therebetween a slot in communication with the vent; and an elongate closure member mounted for parallel motion between a closed position obstructing the slot, and an open position, the closure member having a portion or portions which extend into the slot and to which are pivotally mounted parallel motion links, each link also being pivotally secured with respect to the side walls of the housing; the ventilator having an air opening of at least 4000 $mm^2$ while having external housing dimensions of not more that 450 mm in length, and 30 mm in width; or of at least 2000 $mm^2$ while having external housing dimensions of not more than 270 mm in length, and 30 mm in width.

The ventilator may also be provided with an elongate ventilator hood, for securement to the rear side of the vent in the window or other vent member. Preferably, the hood is shaped so as not to restrict the air flow that can pass through the vent. The rear exit from the vent may be protected by means of a mesh, preferably a mesh which is suitably angled again so as not to restrict the air flow.

In a particularly advantageous arrangement, the opening of the hood and the opening of the housing of the ventilator are substantially equal, giving a "balanced" air flow. The ventilator may be shaped and sized for reception over, and closure of, a vent which will, when unobscured, allow substantially the "balanced" air flow to pass.

The invention may be carried into practice in a number of ways, and two specific embodiments will now be described, by way of example, with reference to the drawings, in which:

DESCRIPTION OF THE PREFERRED EMBODIMENTS

Figure 1:
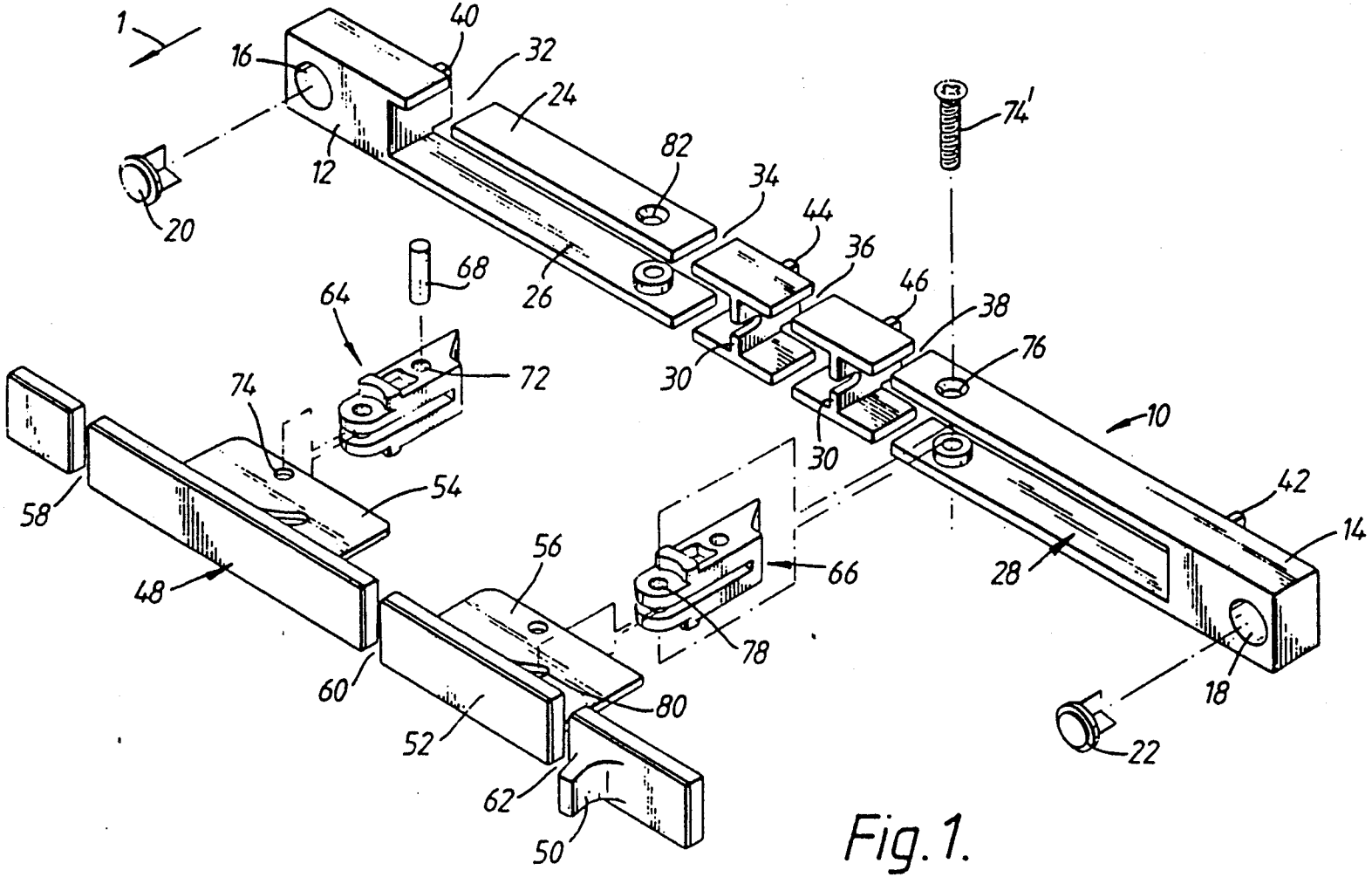
FIG. 1 is an exploded perspective view of a ventilator according to a first embodiment of the present invention.

In this specification and in the claims air opening figures will be given in square millimeters. A statement, for example, that a given ventilator has an air opening of 1000 $mm^2$ means that that ventilator allows through it the amount of airflow that would pass through an entirely open aperture of 1000 $mm^2$ in size.

Also, in the specification and claims the "forward" direction will be taken to be a direction perpendicular to the aperture to be controlled, and towards that side of the aperture on which, in use, control of the ventilator will be effected. This direction will often be perpendicular to the glass of the window in which the ventilator is to be secured, towards the interior of the room. The forward direction in the drawings is shown by the arrow 1.

An exploded view of a ventilator according to a first embodiment of the present invention is shown in FIG. 1. The ventilator has an elongate main housing 10 with mounting portions 12, 14 at the ends whereby the ventilator can be secured to a window sash by means of screws (not shown) passing through screw holes 16, 18. Plugs 20,22 are provided for positioning in the screw holes once the ventilator has been so secured, for cosmetic purposes.

Between the mounting portions 12, 14 are upper and lower elongate side members 24, 26, defining between them an elongate slot or aperture 28. Spaced at intervals along the side members are first and second cross walls 30 for strength. It will be appreciated, of course, that the upper and lower side members are in fact continuous and integral with the mounting portions 12, 14, even though in the diagram they are schematically shown as being cutaway at 32, 34, 36 and 38.

In use, the ventilator will be secured to the front face (not shown) of the member containing the aperture to be controlled, with the aperture in that member lining up with the slot 28. Typically, the aperture to be controlled will be in the timber sash of a window. Desirably, the aperture to be controlled is the same size and shape, or substantially the same size and shape, as the slot 28. Thus, as will be seen, the overall size of the housing 10, particularly in a direction perpendicular to the length of the slot, which is the direction in which there is often very little space between the corresponding aperture in the window sash and the surrounding window frame, is only very slightly larger than the size of the slot itself. To ensure that the ventilator is correctly positioned, the rear of the mounting portions 12, 14, have corresponding mounting lugs 40,42 which are arranged to fit into the ends of the aperture to be controlled. Further mounting lugs 44, 46 are provided at the rear of the crosswalls 30. Positioned generally in front of the main housing 10 is an elongate closure member 48 which is manually operable by means of a handle 50 between a first position in which it seals the slot 28 and a second position in which it is spaced forwardly of the slot, so allowing air to pass through the slot and through the aperture in the window sash. The closure member is of course continuous, although it is shown in the drawing as being cutaway at 58, 60, 62. The closure member 48 comprises a generally flat sealing member 52 having a rear surface adapted to seal against the front surface of the main housing 10. The rear surface of the sealing member has a central upstanding rib (not shown) for strength, this rib being enlarged at two spaced positions along the sealing member to provide first and second mounting plates 54, 56, as shown. The sealing member, the rib and the mounting plates may be integral with one another; alternatively, they may be separate members that are secured together.

Straddling the mounting plates 54, 56 are the parallel legs of respective linking members 64, 66. The linking member 64 is pivotally secured to the mounting plate 54 by a pin 68 which is received within a throughbore 72 of the legs and, between the legs, through a throughbore 74 of the mounting plate. A similar pin, (not shown) provides securement of the other linking member 66 to the mounting plate 56.

Pivoting of the linking member 66 with respect to its plate 56 is limited by a holding screw 74' which extends between holes 76 in the side members 24, 26, between them through holes 78 at the forward end of the legs of the linking member, and between them through a part-circular slot 80 in the mounting plate 56. The other linking member 64 is similarly secured by another screw (not shown) received within the holes 82 of the side members.

When the closure member 48 is in the closed position, the screw 74' is at the rearward end of the slot 80, with the sealing member 52 acting to seal the slot 28. To open the ventilator, the user applies pressure on the handle 50, so moving the closure member 48 away from the main housing, with the linking members 64, 66 ensuring parallel movement. In the fully open position, the screw 74' comes to rest adjacent the forward end of the slot 80.

A gasket (not shown) is provided on the rear of the closure member to assist in sealing. When the ventilator is closed the user can push the handle 50 so that the links 64, 66 move just over top dead centre, thus slightly compressing the gasket and providing a positive feel to the closing movement.

Figure 2:
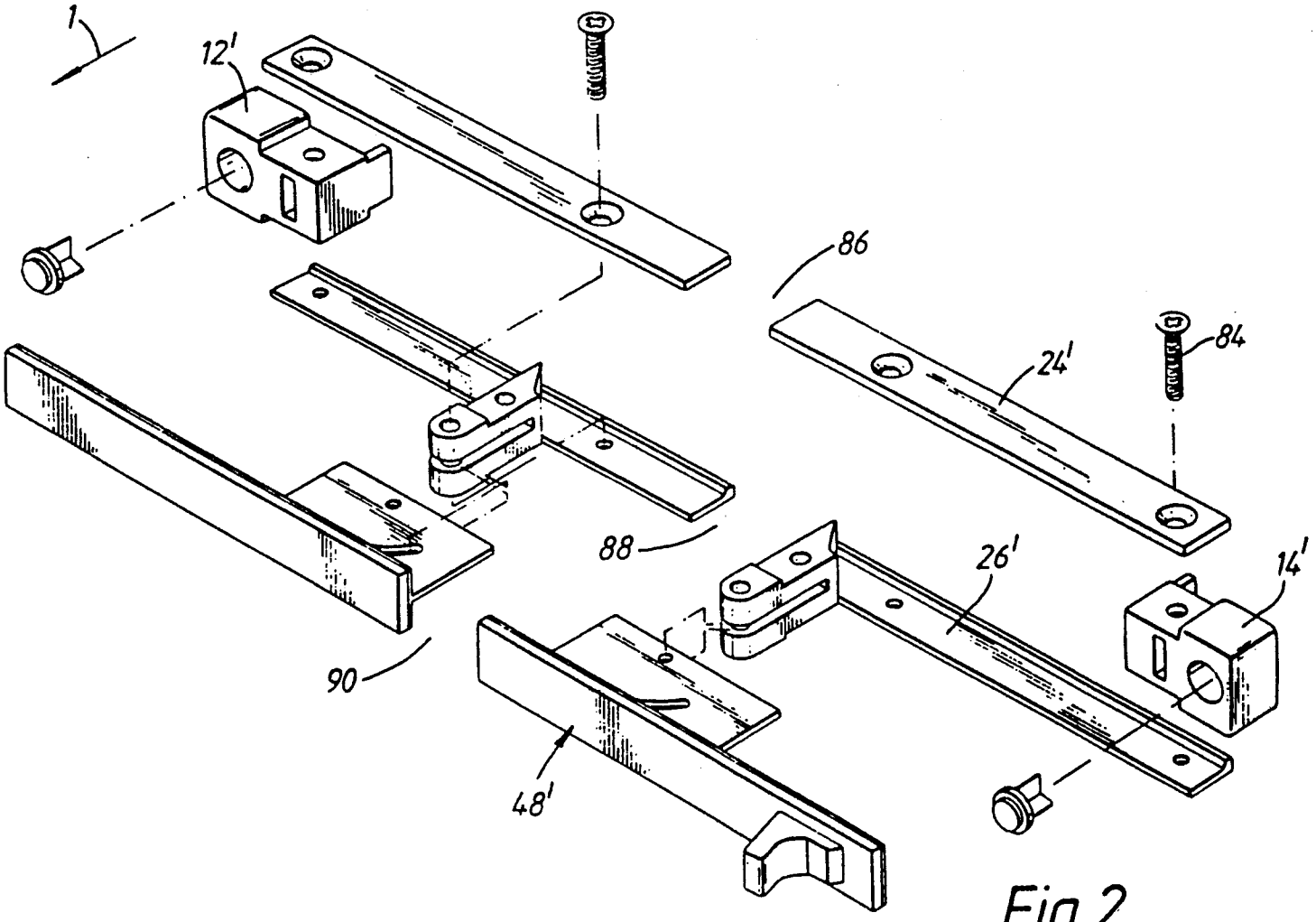
FIG. 2 is a similar drawing of a second embodiment.

In a second embodiment of the invention (FIG. 2) the integral housing 10 of the first embodiment is replaced be separate mounting portions 12',14' and side members 24',26'. The side members are secured to the mounting portions by first and second end screws 84, only when one of which is shown in FIG. 2. Once again, it will be appreciated that the side members and the closure member 48 are in fact continuous, although they are shown in FIG. 2 as being cutaway at 86, 88 and 90.

In either embodiment the screw 74' or 84 could be replaced with a moulded or fixed pin or cross-member (not shown). This saves on manufacturing costs, but means that an access channel has to be provided from the arcuate slot 80 to the outside of the mounting plate 54. 56 so that the pin can be properly located within the slot. This pin can also act as a stop by abutting the plate when the ventilator is its open position. With such an arrangement the links may be in two halves, manufactured to "click -fit" around the pin.

Figure 3:
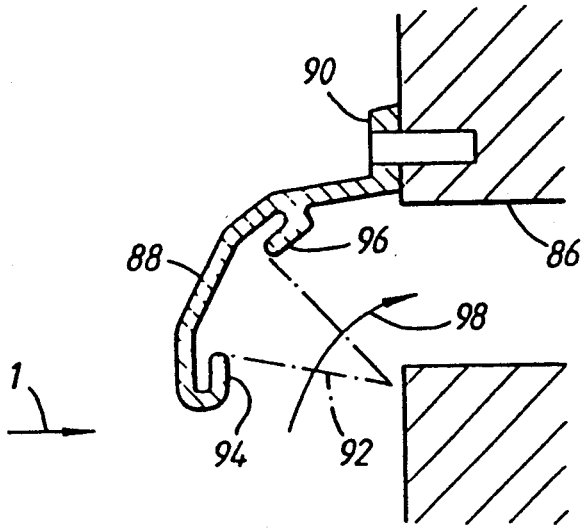
FIG. 3 is a cross section through a ventilator hood, in position on a window, suitable for use with the embodiments of FIG. 1 or FIG. 2.
Figure 4:
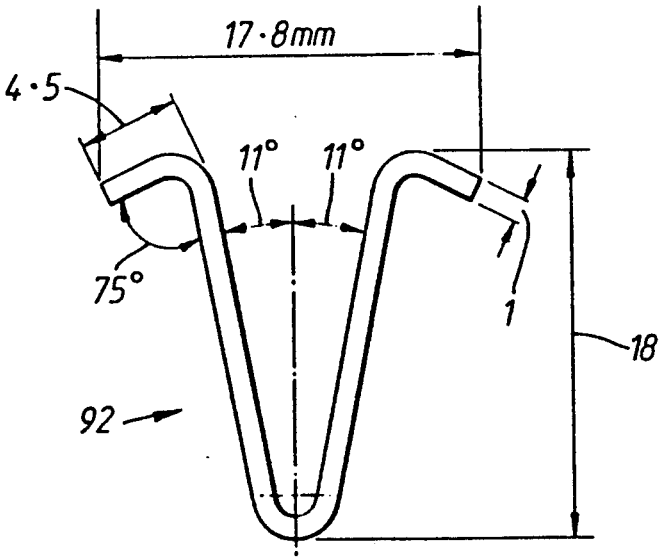
FIG. 4 is a cross section of the mesh shown schematically in FIG. 3.

FIG. 3 shows how the rear of the aperture 86 in the window sash, generally on the outside of the window, is protected by an elongate hood 88, shown here in cross section. The hood is secured by an elongate upper mounting flange 90 immediately above the opening to the aperture 86, and extends outwardly and downwardly over it to protect the aperture from driving wind and rain. A V-shaped elongate metal mesh 32, shown in detail in FIG. 4, is secured to the underside of the hood by mesh mounting flanges 94, 96. The V-shape of the mesh, and the spacing between the lower edge of the hood 88 and the closest point of the window frame are arranged so that there is no additional restriction to the air flow 98 other than that which is inherent in the size of the aperture 86. In other words, even though the solid parts of the mesh will of course take up some of the cross sectional area, the overall cross sectional area that is displayed to the air flow 98 is at least substantially as large as that of the aperture 86.

Alternatively (but not shown) the hood and mesh chould be moulded in one piece from a plastics material.

The opposite ends of the hood are closed by generally quarter-circular end members (not shown).

In the embodiment of FIG. 1, the main parts of the ventilator, with the exception of the screws and the pins are preferably of an acetal resin material, or of any other suitable generally rigid plastics material. In the second embodiment, of FIG. 2, additional rigidity has been provided by manufacturing the side members 24', 26', and the closure member 48,' of aluminium. The mounting portions 12',14' may be of any suitably rigid material, either aluminium or a plastics material. The hood, shown in FIG. 3, is desirably of aluminium, though a hard plastics material could be used, while the hood end members (not shown) are of Delrin (trade mark) The mesh 92, in the embodiment shown, has an open area of 68%.

With the specific embodiments shown the applicants have managed to provide a ventilator having an air opening of 4000 $mm^2$, within a housing which has external dimensions of only 400 mm in length, 17 mm in height and 11.5 mm in depth. Within this housing the internal dimensions of the slot 28 are 348 mm by 12.5 mm. A typical size for the slot in the window sash is 353 mm by 12 mm, giving a total maximum air opening of 4236 $mm^2$. The specific ventilators described will allow through at least 94% of the maximum air flow, that is an air opening at least 4000 $mm^2$. An even smaller aperture in the sash could be used, for example 12 mm by 348 mm, giving a maximum possible air opening of 4176 $mm^2$; in such a case, the ventilator air opening of at least 4000 $mm^2$ represents over 95½% of the maximum possible air opening.

Another embodiment (not shown) has a length of 255 mm and a slot length of 205 mm. The other dimensions being the same, this gives an air flow of about 2000 $mm^2$ for positioning over a vent of 355×13 mm.

Accordingly, it can be seen that an improved ventilator is disclosed. A linkage arranged according to the invention is the opposite of the normal parallel link arrangement, in which the said angle would decrease as the closure member is moved to the closed position. The advantage is that in the open position the link may be generally parallel to the plane of the closure member, rather than generally perpendicular as with the prior art, so that the throw of the closure member may be relatively small. When the closure member is in the closed position the line joining the two pivot points of the link may extend generally perpendicular to the plane of the closure member, with the link then extending backwardly from the side members into the vent. This extension of the links into the vent does not of course act to reduce the effective air opening, since the linkages may be designed so that they only extend in when the closure member is closed or almost closed.

Conveniently, the portion or portions of the closure member to which the links are pivotally secured comprises a rearwardly-extending rib or link mounting plate. One end of the link is pivotally secured to the mounting plate, and the other end of the link is pivotally secured to the side walls by means of a pin which passes through an aperture or a cutaway portion of the plate. This aperture or cutaway portion may conveniently take the form of a part-circular or arcuate guide slot, within which the pin moves as the closure member is moved between the open and closed positions. The ends of this guide slot may act as stops, with the fully open position being defined by the abutment of the pin with the rear end of the slot, and the fully closed position by the abutment of the pin with the front end of the slot.

The linking member may comprise first and second legs, between which, in use, is received the rib or link mounting plate. In this way, the pin may be arranged to pass through apertures in the side walls of the housing, through apertures in the legs of the pin, and through the part-circular or arcuate guide slot.

The housing of the ventilator may be secured to the front face of the vent member by any convenient means, such as screwing or gluing. Preferably, the housing has first and second end mounting portions having bores therein to receive the mounting screws. The first and second parallel side walls may be either integral with, or secured to, these end portions. Similarly, the rib or link mounting plates may either be integral with or secured to the closure member.

In order to assist in locating the housing with respect to the vent, the mounting portions may include locating lugs which, in use, are arranged to be received within the ends of the vent. Similar rearwardly-extending locating lugs may be provided on a cross wall or cross walls extending between the parallel side walls.

Applicants have designed a controllable slot ventilator having an extremely large air opening for its small size. Preferably, indeed, the exterior dimensions of a 4000 $mm^2$ housing may be less than 420 mm by 20 mm, more preferably approximately 400 mm by 17 mm. The depth of the parallel side walls (that is, the distance between the front edge of the housing and the front face of the member to which it is attached in use) is not so critical: it is, however, preferably less than 20 mm, and more desirably less than 15 mm. Most desirably, the depth is substantially 11.5 mm.

The dimensions of a 2000 $mm^2$ housing are the same except for the length: this is preferably less than 260 mm, more preferably approximately 255 mm.

The internal dimensions of a 4000 $mm^2$ slot, between the first and second side walls of the housing, are desirably 348 mm by 12.5 mm or 13 mm, making the ventilator suitable for affixation over a vent of approximately this size. It is desirably sized so that when it is positioned over a vent of about 348 mm by 12.5 mm the vent can be properly sealed and at least 4000 $mm^2$ of air opening can be provided. For a 2000 $mm^2$ slot the length is preferably 210 $mm^2$.

Furthermore, the ventilator of the present invention should preferably be capable of allowing to pass through it an air flow of at least 90%, or at least 93% of the corresponding air flow that would otherwise pass through an aperture having the same internal dimensions as the internal dimensions of the ventilator slot.

We claim:

1. A controllable slot ventilator comprising:

a main housing adapted to be secured to a front face of a member having a vent to be controlled, said housing having first and second parallel side walls located, when said housing is secured to the front of the member, forward of said front face, said side walls defining therebetween a slot in communication with the vent; and an elongate closure member mounted for parallel motion between a closed position, obstructing said slot, and an open position, permitting air flow through said slot, said closure member having at least one portion which extends into said slot, parallel motion links mounted to said at least one portion at a first pivot point and to said side walls at a second pivot point, said parallel motion links rotating as the closure member is moved such that an acute angle between a line passing through said first and second pivot points of each of said links and the general plane of said closure member increases as said closure member moves to said closed position.

2. A ventilator as defined in claim 1, wherein, when said closure member is in said closed position, said line passing through said first and second pivot points of each of said links extends generally perpendicular to the plane of said closure member, with each respective link extending backwardly from said side walls into said vent.

3. A ventilator as defined in claim 2 wherein said at least one portion includes at least one rearwardly extending link-mounting plate and each link is pivotally secured to said at least one rearwardly extending link-mounting plate of said closure member.

4. A ventilator as defined in claim 3 wherein each link is pivotally secured to said side walls by a respective pin which passes through an aperture of a respective one of said plates.

5. A ventilator as defined in claim 4 wherein said aperture or cutaway portion comprises an arcuate guide slot.

6. A ventilator as defined in claim 5 wherein said side walls and said pin are moulded from a plastic material.

7. A ventilator as claimed in claim 6 wherein said side walls and said pin are moulded as a single unit.

8. A ventilator as defined in claim 7 wherein an abutment of said plate and said pin provides a stop for said closure member in its fully open position.

9. A ventilator as defined in claim 8 wherein each link is manufactured in two halves which snap-fit together to engage a respective pin.

10. A controllable slot ventilator comprising a main housing adapted to be assembled to a front face of a member having a vent to be controlled, said housing including first and second parallel side walls defining therebetween a slot communicating with said vent when said housing is assembled over the front face; and an elongate closure member mounted for parallel motion between a closed position obstructing said slot, and an open position, said closure member having at least one portion which extends into said slot, and links pivotally mounted to said closure member and, pivotally secured to said side walls of said housing, the ventilator having an air opening of at least 4000 $mm^2$ while having external housing dimensions of not more than 450 $mm^2$ in length, and 30 mm in width; or of at least 2000 $mm^2$ while having external housing dimensions of not more than 270 mm in length, and 30 mm in width.

11. A ventilator as defined in claim 10 in combination with a ventilator hood adapted to be positioned over said vent, the air openings of the hood and ventilator being substantially equal.

12. A ventilator as defined in claim 1 wherein each said at least one portion includes at least one rearwardly extending link-mounting plate and said link is pivotally secure to said at least one rearwardly-extending link-mounting plate of the closure member.

13. A ventilator as defined in claim 1 wherein each link is pivotally secured to said sidewalls by a respective pin which passes through an aperture of a respective one of said plates.

14. A ventilator as defined in claim 13 wherein said aperture comprises an arcuate guide slot.

15. A ventilator as defined in claim 14 wherein said side walls and said pin are molded from a plastic material.

16. A ventilator as defined in claim 16 wherein said side walls and said pin are molded as a single unit.

17. A ventilator as defined in claim 13 wherein an abutment of said plate and said pin provides a stop for said closure member in its fully open position.

18. A ventilator as defined in claim 13 wherein each link is manufactured in two-halves which snap-fit together to engage a respective pin.

19. A ventilator as defined in claim 1 in combination with a ventilator hood adapted to be positioned over said vent opposite the ventilator, the air openings of the hood and ventilator being substantially equal.

20. A ventilator as claimed in claim 9 in combination with a ventilator hood adapted to be positioned over said vent opposite the ventilator, the air openings of the hood and ventilator being substantially equal.

21. A controllable slot ventilator comprising:

a main housing adapted to be secured to a front face of a member having a vent to be controlled, said housing having first and second parallel side walls located, when said housing is secured to the front of said member forward of said front face, said side walls defining therebetween a slot in communication with said vent;

an elongate closure member mounted for parallel motion between a closed position, obstructing said slot, and an open position, permitting air flow through said slot, said closure member having at least one portion which extends into said slot, said at least one portion including grooves; and parallel motion links mounted to said at least one portion at a first pivot point and to said side walls at a second pivot point, said parallel motion links including means for mounting said second pivot point of each of said respective links on said side walls, each of said mounting means positioned in a respective one of said grooves for sliding movement in said groove when said links pivot around their respective said first and second pivot points and said closure member moves relative to said housing and between open and closed positions.

22. A ventilator as defined in claim 2 wherein said at least one portion includes at least one rearwardly extending link-mounting plate and each link is pivotally secured to said at least one rearwardly extending link-mounting plate of said closure member.

23. A ventilator as defined in claim 4 wherein said groove is arcuate and said mounting means is a pin which moves through said slot.

* * * * *

UNITED STATES PATENT AND TRADEMARK OFFICE

CERTIFICATE OF CORRECTION

PATENT NO. : 5,244,434
DATED : September 14, 1993
INVENTOR(S) : Arthur Stoney et al.

It is certified that error appears in the above-indentified patent and that said Letters Patent is hereby corrected as shown below:

column 4, line 52: "be" should be --by--;
column 4, line 25: "is its" should be --is in its--;
column 5, line 8: "mesh 32" should be --mesh 92--;
column 5, line 21: "chould" should be --could--;
column 5, line 35: after "(trademark)" insert --.--;
column 8, line 20: "claim 16" should be --claim 1--.

Signed and Sealed this

Twenty-first Day of June, 1994

Bruce Lehman

*Attest:*

BRUCE LEHMAN

*Attesting Officer*

*Commissioner of Patents and Trademarks*